US007650772B2

(12) United States Patent
Minor

(10) Patent No.: US 7,650,772 B2
(45) Date of Patent: Jan. 26, 2010

(54) ROTARY FLARING TOOL AND METHOD OF USE

(76) Inventor: Rodger D. Minor, 1401 N. Sumner Rd., Bethpage, TN (US) 37022

( * ) Notice: Subject to any disclaimer, the term of this patent is extended or adjusted under 35 U.S.C. 154(b) by 0 days.

(21) Appl. No.: 11/728,511

(22) Filed: Mar. 26, 2007

(65) Prior Publication Data

US 2008/0236233 A1 Oct. 2, 2008

(51) Int. Cl.
*B21D 19/00* (2006.01)
*B21D 41/00* (2006.01)

(52) U.S. Cl. ..... 72/112; 72/115; 72/307.1

(58) Field of Classification Search ..... 72/112, 72/115, 118, 125, 370.06, 370.1, 370.11
See application file for complete search history.

(56) References Cited

U.S. PATENT DOCUMENTS 2,861,623 A * 11/1958 Franck ..... 72/124
3,078,907 A * 2/1963 Franck ..... 72/126
4,716,752 A * 1/1988 Diller ..... 72/118
4,831,855 A * 5/1989 Wagner ..... 72/118

* cited by examiner

*Primary Examiner*—Dana Ross
*Assistant Examiner*—Debra M Sullivan
(74) *Attorney, Agent, or Firm*—Michael E. McKee

(57) ABSTRACT

A tool and process for flaring an open end of a hollow metal tube utilizes a body having an elongated working surface which is substantially conical in shape so that one end of the working surface is a smaller end and so that the other end of the working surface is a larger end. The working surface further includes at least two outwardly-extending, smooth-surfaced protuberances which are regularly spaced around the working surface and which extend along the length thereof so that by rotating the tool about its longitudinal axis, inserting the smaller end of the working surface into an open end of a hollow metal tubing, and then urging the working surface against the open end of the metal tubing, the open end of the metal tubing is flared by the working surface.

16 Claims, 5 Drawing Sheets

ROTARY FLARING TOOL AND METHOD OF USE

BACKGROUND OF THE INVENTION

This invention relates generally to means and methods for working upon a length of metal tubing and relates, more particularly, to the means and methods for flaring the end of a length of hollow metal tubing.

An exemplary application with which this invention is concerned involves the assembly of heat exchangers comprising a plurality, or stack, of fins (formed, for example, in a stamping process) and a plurality of metal tubes, or tubing, which extend through the stack of fins in a substantially parallel arrangement. In particular and to facilitate the positioning of a preformed ring of soldering material into an open end of each tube to facilitate the attachment of a U-tube within the end of the tube, the open end of the tube is flared outwardly, or belled. By subsequently positioning a ring of soldering material and (the end of) a U-tube within the flared end of a heat exchanger tube and then heating the tube end, the U-tube is brazed, and thereby sealingly attached, to the end of the tube with the soldering material.

Heretofore, the ends of such metal tubes have been flared in conjunction with a process which expands each tube along the length thereof to secure the tubes into place within the fins of the heat exchanger. For example, a rod having a bullet-shaped leading end can be forced through each tubing to expand the tubing along its length, and an appropriately-shaped forming tool which is slidably positioned about the rod can be forced (i.e. pressed or impacted) into the open end of the tubing to further expand the end of the tubing for a short distance therealong to accept the end of a U-tube inserted therein and to flare the open end of the tubing.

However, such a tube-flaring operation which necessitates the forcing of a conventional tool against the open end of a tube can damage (i.e. split) the tube at the end thereof so that a seal cannot be formed with a U-tube subsequently brazed to the tube end. If such damage occurs, the tube—as well as a heat exchanger coil being constructed with the tube—is normally scrapped; and frequent tube damage can lead to incipient production costs.

Accordingly, it is an object of the present invention to provide a new and improved tool for flaring the open end of a hollow metal tube and a method of using the tool.

Another object of the present invention is to provide such a tool which is less likely to damage the open end of a tube than is a conventional tool pressed or impacted against the open end of the tube.

Still another object of the present invention is to provide such a tool and method which are particularly well-suited for use during the construction of heat exchangers wherein the open end of a hollow metal tubing must be sealingly secured to the end of a U-tube with a ring of soldering material.

Yet another object of the present invention is to provide such a tool which is uncomplicated in construction yet effective in operation.

SUMMARY OF THE INVENTION

This invention resides in a tool for flaring an open end of a hollow metal tube and a method of using the tool.

The tool includes an elongated body having two opposite end portions and a longitudinal axis extending between the opposite end portions. One end portion of the body defines an elongated working surface having two opposite ends, and a major portion of the working surface which extends between the two opposite ends is conical in shape so that one end of the working surface is a smaller end and so that the other end of the working surface is a larger end. Furthermore, the smaller end of the working surface is adapted to be received by an open end of a hollow metal tube when inserted therein, and the working surface includes at least two smooth-surfaced ribs which are regularly spaced around and extend along the length of the working surface between the larger and smaller ends thereof to provide the working surface with outwardly-extending smooth-surfaced protuberances. By rotating the tool about its longitudinal axis, inserting the smaller end of the working surface into an open end of a hollow metal tubing, and then urging the smooth-surfaced protuberances against the open end of the metal tubing, the open end of the metal tubing is flared by the working surface.

The method of the invention includes the steps involved in flaring the open end of a hollow metal tube with the tool of the invention. In particular, the tool is initially provided, and then the tool is rotated about its longitudinal axis and the smaller end of the working surface is inserted into an open end of the hollow metal tubing by urging the working surface against the open end of the metal tubing, the open end of the metal tubing is worked, and thereby flared, by the working surface.

Figure 6:
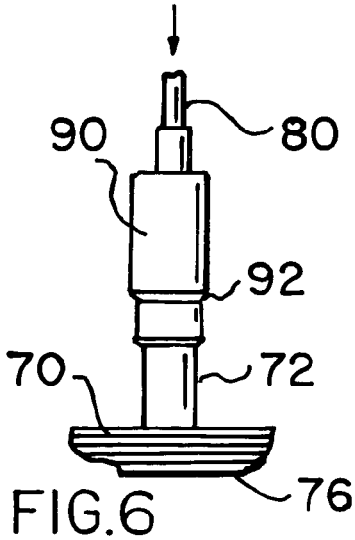
FIG.6 PRIOR ART
FIG. 6 is a view similar to that of FIG. 5 but illustrating the FIG. 5 tooling being used to impact the open end of a tube of the heat exchanger coil under construction.

FIG. **6*a* is a view of a heat exchanger tube whose end has been damaged (i.e. split) with the bell-forming process depicted in FIG. 6**.

Figure 5:
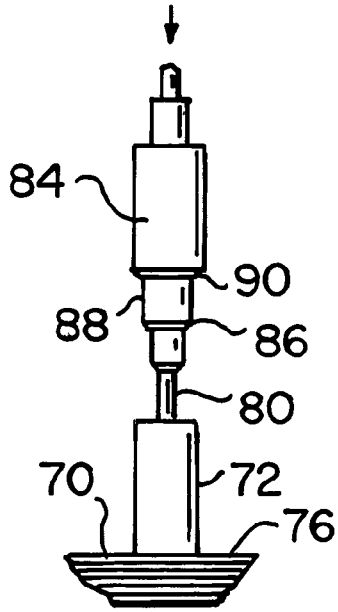
FIG.5 PRIOR ART
FIG. 5 is an enlarged view of a fragment of the prior art tooling shown in FIG. 4 and a fragment of a heat exchanger coil under construction.
Figure 7:
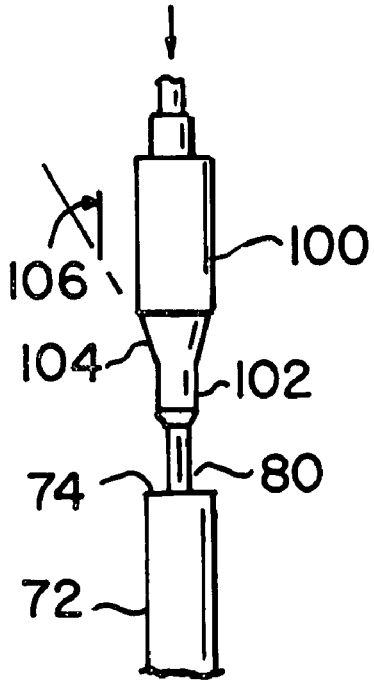

FIG. 7 is a view similar to that of FIG. 5 of an alternative forming tool and fragment of a tube of a heat exchanger coil under construction.

Figure 8:
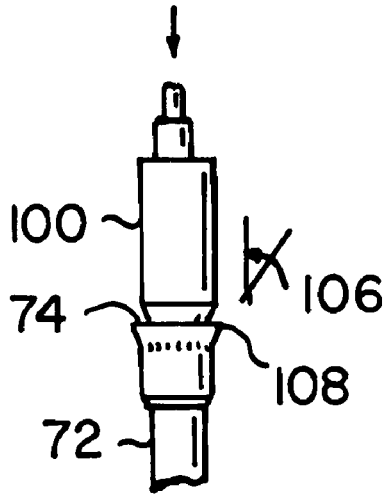

FIG. 8 is a view similar to that of FIG. 7 but illustrating the FIG. 7 tool being used to form a pilot bell in the open end of the tube of the heat exchanger coil under construction.

Figure 1:
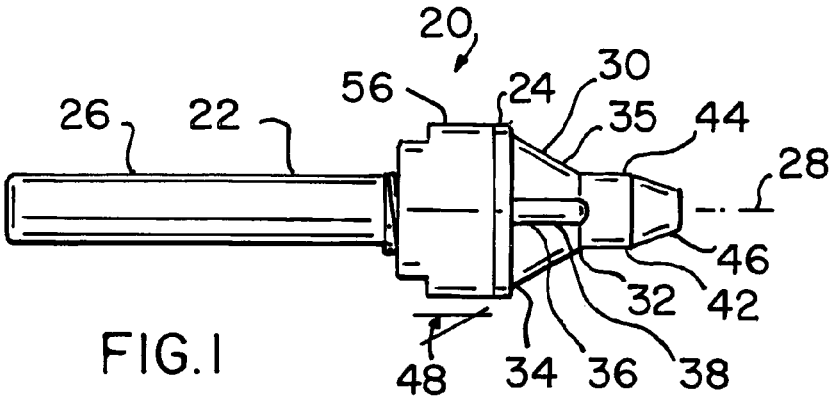
FIG. 1 is a side elevational view of a rotary flaring tool within which features of the present invention are embodied.
Figure 2:
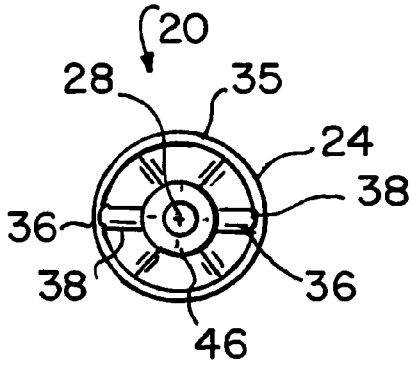
FIG. 2 is an end view of the FIG. 1 tool as seen from the right in FIG. 1.
Figure 3:
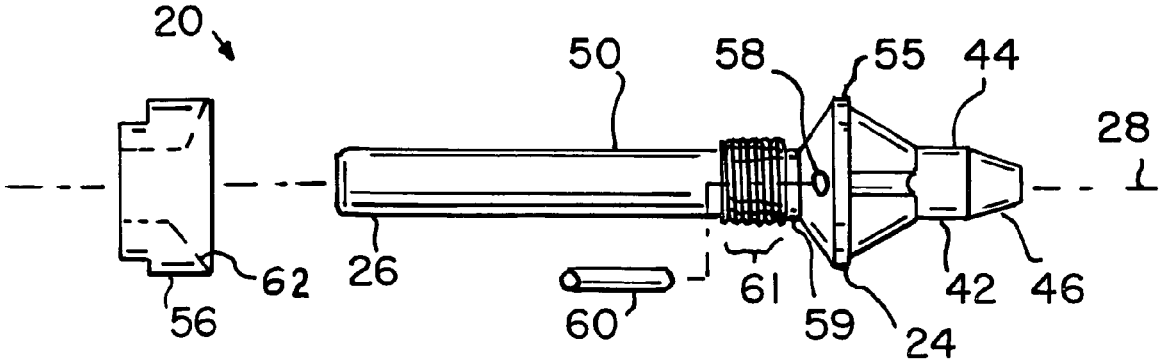
FIG. 3 is a side elevational view of the FIG. 1 tool similar to that of FIG. 1, but shown exploded.
Figure 9:
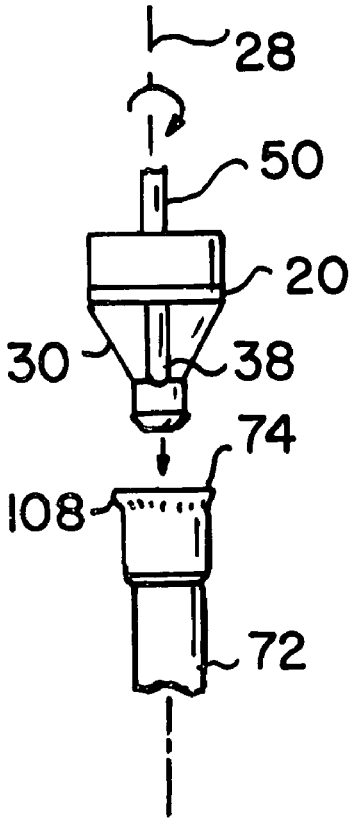

FIG. 9 is a side view illustrating the flaring tool of FIGS. 1-3 when positioned in registry with the open end of the tube of FIG. 8 within which a pilot bell has been formed.

Figure 10:
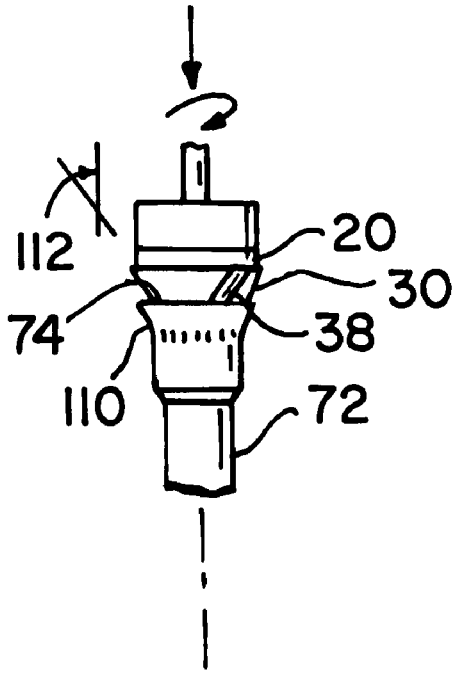

FIG. 10 is a view similar to FIG. 9 but illustrating the flaring tool after being moved into working engagement with the open end of the heat exchanger tube.

Figure 11:
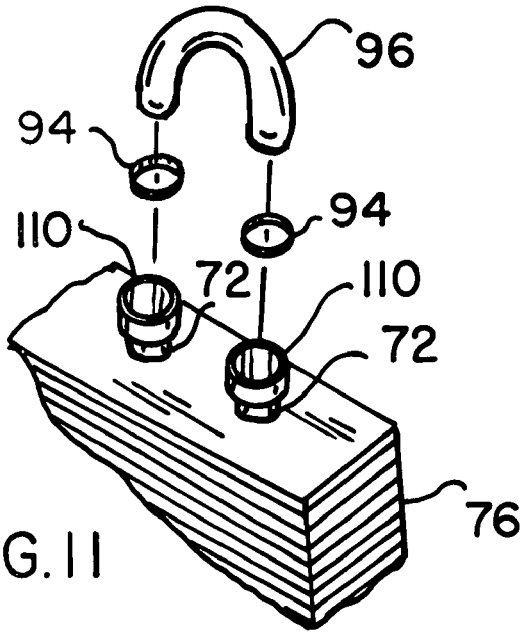

FIG. 11 is a perspective view illustrating a fragment of an end of a heat exchanger coil, shown before assembly.

Figure 12:
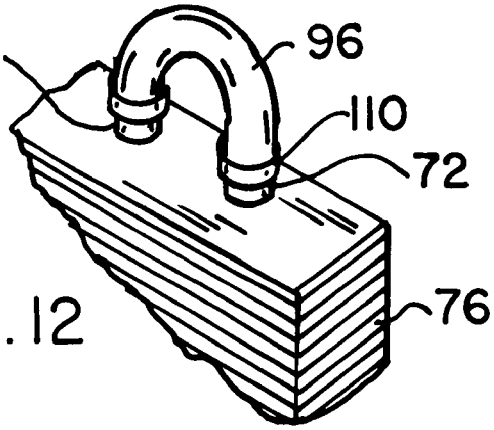

FIG. 12 is a view similar to that of FIG. 11 illustrating the end of the heat exchanger coil, shown assembled.

Figure 13:
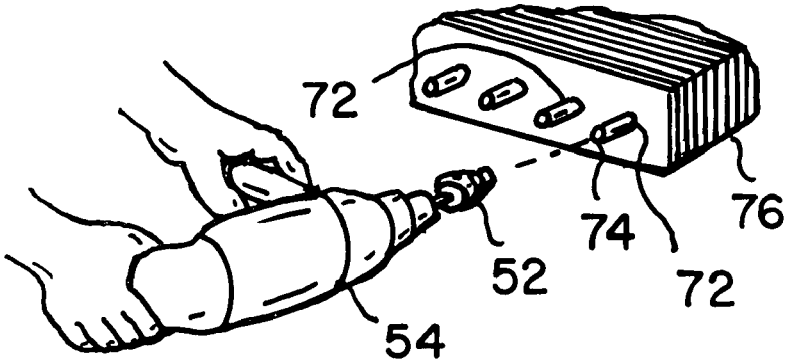

FIG. 13 is a perspective view of another exemplary method for using the flaring tool of FIGS. 1-3.

Figure 14:
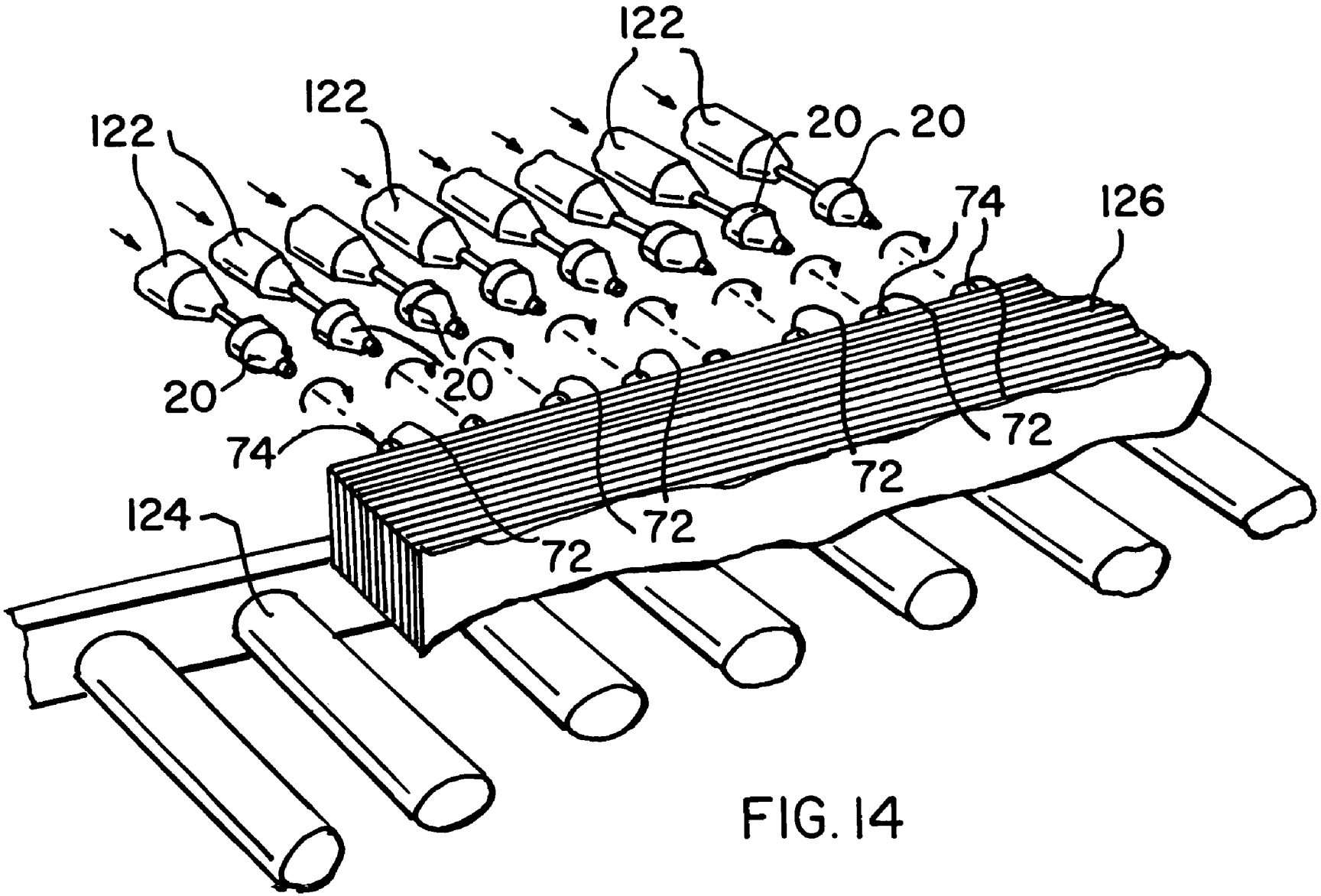

FIG. 14 is an alternative view of the flaring tool of FIGS. 1-3 and a plurality of flaring tools of like construction being used to simultaneously flare several tubes of a heat exchanger under construction.

DETAILED DESCRIPTION OF AN ILLUSTRATIVE EMBODIMENT

Turning now to the drawings in greater detail and considering first FIGS. 1-3, there is illustrated an embodiment, generally indicated 20, of a tool within which features of the present invention are embodied. The tool 20 includes an elongated body 22 having two opposite end portions 24 and 26 and a longitudinal axis 28 extending between the two end portions 24 and 26. One end portion 24 (i.e. the head end) of the body 22 defines an elongated working surface 30 having two opposite ends 32, 34, and a major portion, indicated 35, of the working surface 30 which extends between the two opposite ends 32 and 34 is conical in shape so that one end 32 of the working surface 30 is a smaller end 32 and the other end 34 of the working surface 30 is a larger end 34.

The smaller end 32 of the working surface 30 is adapted to be received by an open end of a hollow metal tube 72 (FIG. 9) when inserted therein, and the working surface 30 further includes a pair of two smooth-surfaced ribs 36 which are disposed on opposite sides of the working surface 30 (i.e. regularly spaced therearound) and which extend along the length of and between the larger and smaller ends 34, 32 of the working surface 30 to provide the working surface 30 with outwardly-extended smooth-surfaced protuberances 38.

Within the depicted tool 20, each of the conical surface of the major portion 35 and the ribs 36 of the working surface 30 form an angle 48 of about thirty degrees with the longitudinal axis 28 of the tool 20. Such an angle ensures that a flare which is formed in the open end of a tube with the tool 20 flares outwardly with respect to the longitudinal axis of the tube by about thirty degrees.

The end portion 24 of the tool body 22 further includes a tip section 42 which extends forwardly of the smaller end 32 of the working surface 30 along the longitudinal axis 28. The tip section 42 includes a cylindrically-surfaced portion 44 which is joined to the working surface 30 and a frustoconical portion 46 which is joined to the cylindrically-surfaced portion 44 opposite the working surface 30. The cylindrically-surfaced portion 44 is slightly smaller in diameter than the inside diameter of a hollow tube whose end is to be flared by the tool 20.

As will be apparent herein and in order to flare the open end of a metal tube with the tool 20, the end portion 24 of the tool 20 is inserted into the tube end so that the working surface 30 is moved into engagement with the surface of the tube at the end thereof. The frustoconical portion 46 helps to guide the tool 20 into the open end thereof as the tool is operatively inserted therein, and the cylindrically-surfaced portion 44 (which, as mentioned earlier, is slightly smaller than the inside diameter of the tube to be flared) helps to maintain the tool 20 in axial alignment with the tube so that the working surface 30 will properly engage the open end of the tube.

The opposite end portion 26 of the tool 20 is adapted to be supported by the holding means of an apparatus capable of rotating the tool 20 about its longitudinal axis 28. Within the depicted tool 20, the end portion 26 is in the form of a cylindrical shank 50 adapted to be held by the chuck 52 (FIG. 13) of a portable hand tool 54 (e.g. a drill) for rotation of the tool 20 about its longitudinal axis 28. Hence and in relation to the shank 50, the smaller end 32 of the working surface 30 can be considered as a distal end of the working surface 30 while the larger end 34 can be considered as a proximal end of the working surface 30.

During construction of the tool 20 and with reference to FIG. 3, a metal piece 55 can be appropriately machined, i.e. formed, to provide much of the working end 24 (i.e. the head end) for the tool 20, and a pair of appropriately-sized openings 58 (only one shown in FIG. 3) can be formed, i.e. drilled, in the piece 55 to closely accept cylindrical dowel pins 60 (only one shown in FIG. 3) inserted into the openings 58. In the interests of the present invention, each dowel pin 60 is closely accepted by the corresponding opening 58 if, when the pin 60 is positioned within the opening 58, there exists very little space between the cylindrical surface of the pin 60 and the inside surface of the opening 58.

When positioned within the openings 58, the exposed surfaces of the dowel pins 60 provide the smooth-surfaced protuberances 38 of the working surface 30. Furthermore, the pins 60 are slightly smaller in diameter than the diameter of the openings 58 to accommodate the permitted rotation of the pins 60 within the openings 58 during tool operation. The cylindrical shank 50 can be threadably received by an internally-threaded opening 59 formed within the piece 55 so as to extend axially therein opposite the tip section 42, and a nut 56 can be threaded about a threaded portion 61 of the shank 50 and tightened against the piece 55 to prevent the pins 60 from backing out of the openings 58 and provide a bearing surface 62 against which the pins 60 are permitted to rotate and bear against as the pins 60 are urged into engagement with the open end of a hollow metal tube, as is described herein; and no portion of the bearing surface 62 is oriented in a plane which is perpendicular to the longitudinal axis of the tool.

The tool 20 and, more particularly, the piece 55 comprising the head end 24 of the tool 20 can be constructed of steel possessing a high-carbon, high-chrome content, and its working surface 30 is preferably coated with titanium nitride. Further still, the working surface 30 is appropriately treated so that it possesses a hardness within the range of between 60R and 62R on the Rockwell hardness scale.

Exemplary dimensions of the tool 20 (suitable for flaring a copper tube having a 0.281 inch (7 mm) outer diameter whose end section has been expanded to provide a 0.275 inch inner diameter opening for accepting the end of a U-tube are provided here as follows: The diameter of the cylindrically-surfaced portion 44 of the tip section 42 and the smaller end 32 of the working surface 30 is about 0.272 inch; the diameter of the larger end 34 of the working surface 30 is about 0.625 inches; the diameter of each pin-accepting opening 58 is about 0.127 inches; the diameter of each dowel pin 60 is about 0.125 inches; the width of the exposed portion of each dowel pin 60 (as measured across the working surface 30) is about 0.250 inches; and the exposed portion of each dowel pin 60 extends outwardly away from the conical portion of the working surface 30 by about 0.0313 inches.

The use of the tool 20 will now be described in connection with the attachment of the open end of heat exchanger tubes to U-tubes used to connect the ends of adjacent heat exchanger tubes together.

Figure 4:
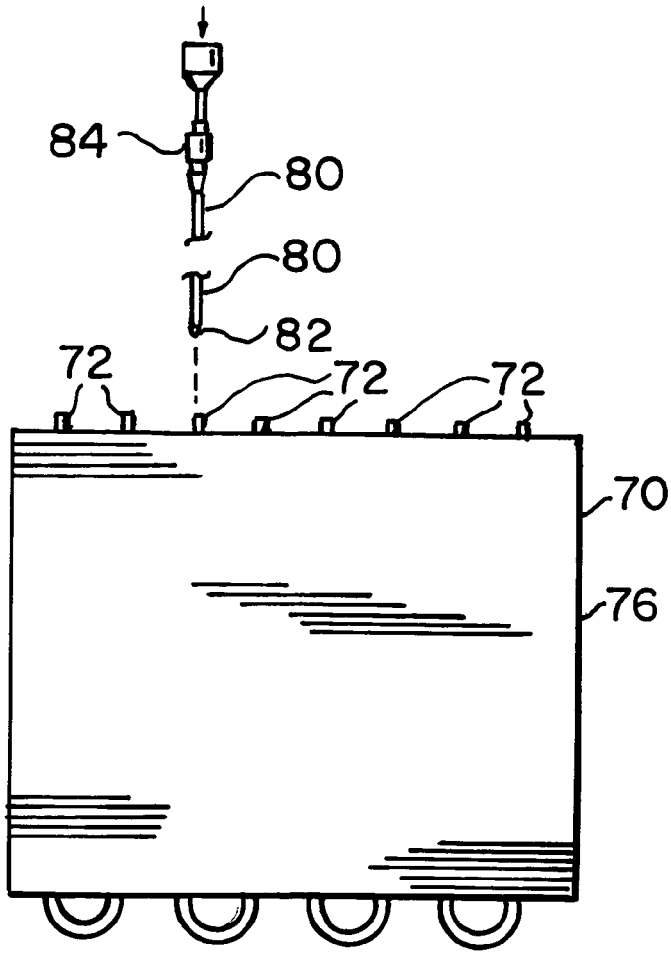
FIG.4 PRIOR ART
FIG. 4 is a view of a heat exchanger coil under construction and prior art tooling employed to expand metal tubing which extends through the coil.

In this connection and with reference to FIG. 4, there is illustrated a heat exchanger 70 having a plurality of tubes 72 which open out of one end (i.e. the upper end as viewed in FIG. 4) of the heat exchanger 70. The tubes 72 of the depicted heat exchanger 70 are comprised of a plurality of lengths of metal tubing (e.g. constructed, for example, of copper having an outer diameter, for example, of about 0.281 inches) which have been bent in the middle to form a U thereat and the linear portions (i.e. those comprising the tubes 72) of the tubing lengths are directed through pre-formed openings defined in a stack of fins 76. Upon insertion of all of the tubes 72 through the stack of fins 76 and as illustrated in FIG. 4, all of the Us of the tubing lengths are disposed along one end (i.e. the lower end as viewed in FIG. 4) of the stack of fins 76 while each open end of the tubes 72 open out of the opposite end of the stack of fins 76. In order that a refrigerant (or some other suitable heat exchange medium) be permitted to flow along a serpentined path back and forth through the heat exchanger 70 by way of the tubes 72, a plurality of U-tubes 96 (FIG. 11), must be sealingly secured upon the open ends of adjacent tubes 72 in the heat exchanger 70.

With reference still to FIG. 4 and in accordance with a procedure known in the prior art, a rod 80 having a bullet-shaped leading end 82 can be forced through each tube 72 through the open end thereof to expand the tube 72 by a small amount so that the tubes 72 become fixed in position within the stack of fins 76 and to enhance the heat exchange relationship between the tubes 72 and the fins 76. In this connection, the outer diameter of the bullet-shaped leading end 82 of the rod 80 is slightly smaller than the inner diameter of the tubing 72 (before expansion), and the leading end 82 is advanced through each tube 72 no further than about the width (i.e. the height as viewed in FIG. 3) of the fin stack to prevent damage to the U formed in the tubing length at the opposite end of the heat exchanger 70. In addition, there is slidably mounted upon the length of the rod 80 a forming tool 84 (best shown in FIGS. 5 and 6) which has an end portion 86 having a cylindrical surface 88 which is sized to further expand the tubing 72 for a short distance (e.g. about 0.235 inches) therein and a blunt shoulder portion 90 which is shaped to form a bell shape 92 (FIG. 6) in the open end of the tube 72 when impacted thereagainst.

In connection with the foregoing, the rod 80 has a length which is coordinated with that of the forming tool 84 so that just before the rod 80 reaches the end of the tubing 72 during a pass therethrough, the end portion 86 further expands the tube 72 (so that its inner diameter is expanded to, for example, about 0.275 inches) for a short distance therein and so the shoulder portion 90 is forced against the open end of the tubing 72. By urging the end of the rod 80 with sufficient pressure (through, for example, the application of an impact force along the rod 80) to complete its passage through the tubing 72, the shoulder portion 86 is urged downwardly against the open end of the tubing 72 so that the tube end is flared outwardly to form the bell shape 92 (FIG. 6). The flaring of the tube end outwardly as illustrated in FIG. 6 shapes the tube end to accept a silver solder ring 94 (FIG. 11) commonly positioned therein by an automated robot and used to braze a U-tube 96 within the tube end.

Figure 6A:
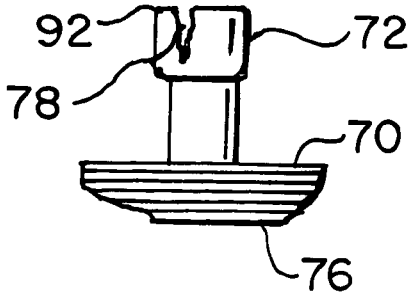
FIG.6a PRIOR ART

As mentioned earlier, the aforedescribed process of FIGS. 4-6 utilized to flare the open end of tubing 72 before a U-tube 96 (FIG. 11) is brazed to the open end of the tubing 72 is known. It is also known that such a process will occasionally result in a longitudinal splitting of the tubing 72 at the open end thereof, as depicted in FIG. 6*a*, from the impact of the tool 84 against the end of the tubing 72. Such damage, or splitting, of the tubing 72 to form a split 78 (FIG. 6*a*) will prevent a satisfactory seal from being formed when a U-tube 96 is subsequently brazed thereto. Consequently, the damaged tubing, along with the entire coil 70 within which the tubing is positioned, is commonly regarded as useless and ultimately scrapped. It follows that frequent damage to the tubing 72 during the construction of heat exchangers can be relatively costly.

To reduce the likelihood that the tube ends will split when a flare is formed in the end thereof, applicant has replaced the prior art forming tool 84 illustrated in FIGS. 4-6 with an improved forming, or pushing, tool 100 (FIGS. 7 and 8) in order to further expand the tubing 72 for a short distance therealong (to accept the end of a U-tube 96 inserted therein) and to form a pilot bell within the open end of the tubing 72; and applicant subsequently employs the rotary flaring tool 20 (FIGS. 1-3, 9 and 10) for completing the desired flare in the tubing end. In this connection and with reference to FIGS. 7 and 8, the improved forming tool 100 is provided with a cylindrically-shaped portion 102, like that of the prior art forming tool 84, to further expand the tube 72 for a short distance therein and also includes a tapered shoulder 104 which is designed to slightly bell the open end of the tubing 72 outwardly and at an angle (e.g. about thirty degrees) at which the desired flare is subsequently formed with the tool 20. In particular and in the depicted forming tool 100 of FIG. 7, the surface of the tapered shoulder 104 forms an angle 106 of about thirty degrees (from the longitudinal centerline of the tool 100) so that when forced against the open end, indicated 74 in FIG. 7, of the tubing 72 as illustrated in FIG. 8 (to complete the pass of the rod 80 through the tubing 72), the open end 74 of the tubing 72 is provided with a short bell 108 which flares outwardly with respect to the longitudinal axis of the tubing 72 at an angle of about thirty degrees. When forced against the open end 74 of the tubing 72 (without any turning or rotation of the tool 100), this tapered shoulder 104 is believed to apply forces to the open end 74 much less abruptly than does the blunt shoulder 90 of the prior art tool 84 so that the chances of damaging the open end 74 of the tubing 72 with the tool 100 is much less than if the prior art forming tool 84 is used.

Following the formation of the short bell 108, the flaring tool 20 is used with appropriate rotating means for completing the desired flare in the open end 74 of the tubing 72. In this connection and with reference to FIGS. 9 and 10, the flaring tool 20 is positioned in axial registry with the tube 72 so that the smaller end 32 of the tool working surface 30 is directed toward the tube end 74 as illustrated in FIG. 9 and the tool 20 is rotated about its longitudinal axis 28 at a speed of, for example, between about 300 and 400 revolutions per minute (rpm). For purposes of rotating the tool 20 about it longitudinal axis 28, the shaft 50 of the tool 20 is fixedly secured within the tool-holding device (e.g. a mandrel or chuck) of an appropriate rotating means. The tool is then moved toward the open end 74 of the tube 72 so that the working surface 30 and, in particular, the protuberances 38, engage the surfaces of the tube end 74. For this purpose, the previously formed short bell 108 (FIG. 8) provides a pilot bell which helps to guide the tool 20 into engagement with the tube end 74.

By urging the rotating tool 20 against the tube end 74, the metal of the tube 72 is worked by the protuberances 38 until the desired flare, indicated 110 in FIG. 10, is formed. More specifically and as the rotating tool 20 engages the tubing end 74, the protuberances 38 work the metal of the tubing 72 so that the tubing end 74 is reshaped from a substantially cylindrical shape into the desired flare 110. Furthermore and because the dowel pins 60 (FIG. 3) which define the protuberances 38 are permitted to rotate within the openings 58 (FIG. 3), heat which might otherwise build up during a flaring operation is substantially reduced. Along the lines of the foregoing, it has been found that no lubrication, in addition to residual lubrication left from an operation to form the opening 58, is necessary for lubricating the spacing provided between the walls of the openings 58 and the surfaces of the dowel pins 60.

Upon formation of the flare 110 to a desired depth (e.g. so that the outer diameter of the flared end is expanded to about 0.4200 inches), the rotating tool 20 is withdrawn from the tubing end 74. It follows that because the working surface 30 and, in particular, the surfaces of the protuberances 38 form an angle of about thirty degrees in relation to the longitudinal axis 28 of the tool 20, the resulting flare 110 formed with the flaring tool 20 also forms an angle 112 (FIG. 10) of about thirty degrees with the longitudinal axis of the tubing 72.

With reference to FIG. 11 and upon completion of the formation of a flare 110 in the open ends of the adjacent tubes 72 in a coil 76 being constructed, a U-tube 96 is positioned within and brazed to the ends of the adjacent tubes 72. To this end and with reference still to FIG. 11, a solid ring 94 of silver soldering material (comprised, for example, of about forty percent silver and about sixty percent brass) is positioned within each of the flared ends 74 of the tubes 72, and the ends of the U-tube 96 are then directed into the flared ends 74 and seated into the bottom of the further-expanded end portions of the tubes so that the rings 94 of soldering material are sandwiched between the inside surfaces of the flared ends 74 and the outer surfaces of the ends of the U-tube 96. The ends of the tubes 72 are then heated with appropriate equipment (not shown) to an elevated temperature (e.g. about 1800° F.) to melt the material of the ring 114 and thereby braze the tube ends to the U-tube 96.

Referring again to the rotation of the flaring tool 20 about its longitudinal axis 28, this can be effected by any of a number of methods. One method, as illustrated in FIG. 13, involves a portable (e.g. hand-held) tool, such as a drill 54, having a chuck 52 within which the shank 50 of the tool 20 is securely fastened. In particular and while rotating the tool 20 with the drill 54, the smaller end 32 of the working surface 30 of the tool 20 can be directed into and urged against the surface of the tube end 74 to form a desired flare 110 (FIG. 10) therein. Upon completion of the formation of the desired flare 110, the tool 20 is withdrawn from the tubing end 74.

An alternative approach for flaring tube ends involves a computer numerically-controlled (CNC) machine (e.g. a robot) capable of both holding and rotating the tool 20 from the shaft end thereof and advancing the rotating tool 20 into the open end of the tubing 72 when the tubing 72 is moved (e.g. indexed) into axial registry with the tool 20. For example and with reference to FIG. 14, there is illustrated a CNC machine 120 having a plurality of (i.e. eight) tool-supporting mandrels 122 for supporting a group of eight flaring tools 20 so that the rotation axes thereof are in parallel relationship. With the tools 20 arranged in such a manner, the tube-end of a coil 126 being formed can be moved, or conveyed along a conveyor 124, into working relationship with the tools 20 so that each tool 20 of the tool group is axially aligned with the open end 74 of a corresponding tubing 72. The tools 20 are then rotated by the CNC machine 120 and then directed simultaneously into the open ends 74 of the tubes 72 to form the desired flare therein. It follows that during a flaring operation, the coil 126 is braced against movement by the tools 20 as the tools 20 are urged against the open ends of the coil tubes. Upon completion of the desired flare in the tubes 72, the tools 20 are withdrawn by the CNC machine 120 (e.g. to a READY position), and another group of tubes of the coil (or the next coil in sequence) are indexed into working relationship with the group of tools 20.

Since the number of tubes positioned within a heat exchanger coil being constructed is commonly a multiple of eight, a CNC machine 120 capable of holding and operating eight tools 20 at a time has been found to enhance production efficiency. With such an arrangement, a coil can be uniformly indexed in relation to the CNC machine to keep the number of flaring cycles needed for any one coil as low as possible. For example, if a coil has sixteen tubes, then the coil would only have to be indexed into working relationship with such a tool twice to form flares in all of the open ends of the tubes.

It will be understood that numerous modifications and substitutions can be had to the aforedescribed embodiment without departing from the spirit of the invention. For example, although the aforedescribed tool embodiment 20 has been shown and described as being used to flare the open end 74 of a hollow tube 72 after a short (i.e. pilot) bell 108 has been formed with a forming tool 100 in the open end 74 of the tubing 72, it will be understood that the formation of a short bell 108 in the open tubing end 74 is not absolutely necessary before the tool 20 can be used to flare the tube end 20 to the desired depth. Such a possibility can be advantageous in the event that a bell must be formed (with, for example, with the portable drill 54 of FIG. 13) in a tube whose end 74 has not been exposed to the forming tool 100.

Further still and although the tubing 72 has been described herein as being comprised of copper, hollow tubing comprised of other metals, such as steel and stainless steel along with ferrous and non-ferrous metals, can be flared with the tool 20. A flare in such tubing may be desired to form, for example, a metal brake line for a vehicle.

Accordingly, the aforedescribed embodiment is intended for the purpose of illustration and not as limitation.

The invention claimed is:

1. A tool for flaring an open end of a hollow metal tube having an inner diameter, the tool comprising:

an elongated body having two opposite end portions and a longitudinal axis extending between the opposite end portions, one end portion of said body defining an elongated working surface having two opposite ends, the working surface has a major portion which extends between the two opposite ends thereof and which is conical in shape so that one end of the working surface is a smaller end and the other end of the working surface is a larger end, the smaller end of the working surface is adapted to be received by an open end of a hollow metal tube when inserted therein and wherein the working surface further includes at least two smooth-surfaced protuberances which are regularly spaced around the working surface and which extend along the entire length of the working surface between the larger and smaller ends thereof;

wherein the one end portion of said body further includes a cylindrical tip section which is joined to and extends axially of the working surface from the smaller end thereof and which has a cylindrical surface which has a diameter which is slightly smaller than the inner diameter of the open end of the hollow metal tube to be flared by the tool for acceptance by the open end of the hollow metal tube when inserted therein so that by rotating the tool about its longitudinal axis, inserting the cylindrical tip section into the open end of the hollow metal tube, and urging the smooth-surfaced protuberances into engagement with the open end of the metal tube, the cylindrical surface of the cylindrical tip section maintains the working surface in axial alignment with the metal tube and the open end of the metal tube is flared by the working surface; and the one end portion further includes cylindrical dowel pins having surfaces and a remainder within which the cylindrical dowel pins are rotatably captured, and wherein the smooth-surfaced protuberances are provided by the surfaces of the cylindrical dowel pins which are rotatably captured within the remainder of the one end portion to accommodate rotation of the dowel pins about rotation axes and relative to the remainder of the one end portion when the tool is rotated about its longitudinal axis and the surfaces of the cylindrical dowel pins are urged into engagement with the open end of the metal tube and wherein the rotation axis of each dowel pins forms an angle with the longitudinal axis of the tool.

2. The tool as defined in claim 1 wherein the end portion of said body opposite said one end portion is adapted to be connected in driven relationship with means for rotating the tool about its longitudinal axis.

3. The tool as defined in claim 1 wherein there are two cylindrical dowel pins which are regularly disposed around the working surface of the one end portion.

4. The tool as defined in claim 1 wherein the surface of the conical shape of the major portion of the working surface forms an angle of about thirty degrees with respect to the longitudinal axis of the tool.

5. The tool as defined in claim 1 wherein each smooth-surfaced protuberance of the working surface forms an angle of about thirty degrees with respect to the longitudinal axis of the tool.

6. The tool as defined in claim 1 in combination with a computer-controlled machine which is capable of rotating the tool about its longitudinal axis and automatically advancing the tool into engagement with the open end of the metal tube so that the open end of the metal tube is flared by the working surface of the tool.

7. The tool as defined in claim 1 wherein said one end of the elongated body of the tool is constructed of a high carbon, high chrome steel.

8. The tool as defined in claim 1 wherein the diameter of the cylindrical surface of the cylindrical tip section is about 0.003 inches smaller than the inner diameter of the metal tube to be flared by the tool.

9. A tool for flaring an open end of a hollow metal tube having an inner diameter, the tool comprising:

an elongated body having a longitudinal axis, a shaft end with which the tool can be rotated about its longitudinal axis, and a head end opposite the shaft end, the head end including a working surface which is shaped so that when the tool is rotated about its longitudinal axis and urged head end-first into an open end of a hollow metal tube, the open end is flared by the working surface, the working surface having a distal end and an opposite proximal end disposed between the distal end and the shaft end of the tool, and the working surface being shaped so that the distal end is smaller than the proximal end and defining at least two smooth-surfaced ribs which are regularly spaced around the working surface and extend along the entire length of the working surface between the distal and proximal ends thereof and wherein each smooth-surfaced rib forms an acute angle with respect to the longitudinal axis of the tool as a path is traced along each rib from the distal end to the proximal end;

wherein the head end of the elongated body further includes a cylindrical tip section which is joined to and extends axially from the working surface from the distal end thereof and which has a cylindrical surface which has a diameter which is slightly smaller than the inner diameter of the open end of the hollow metal tube for acceptance by the open end of the tube when inserted therein so that by rotating the tool about its longitudinal axis, inserting the cylindrical tip section into the open end of the hollow metal tube and urging the working surface into engagement with the open end of the tube as the working surface is guided into engagement with the open end of the tube by the cylindrical tip section, the cylindrical surface of the cylindrical tip section cooperates with the metal tube to maintain the working surface in axial alignment with the metal tube; and the head end further includes cylindrical dowel pins having surfaces and a remainder having openings within which the cylindrical dowel pins are rotatably captured, and wherein the smooth-surfaced ribs are provided by the surfaces of the cylindrical dowel pins which are rotatably captured within the openings formed within the remainder of the head end of the elongated body to accommodate rotation of the dowel pins about rotation axes and relative to the remainder of the head end when the tool is rotated about the longitudinal axis of its elongated body and the surfaces of the cylindrical dowel pins are urged into engagement with the open end of the hollow metal tube and wherein the rotation axis of each dowel pin forms an angle with the longitudinal axis of the elongated body; and wherein the remainder of the head end provides bearing surfaces against which the cylindrical dowel pins are permitted to rotate and bear against as the dowel pins are urged into engagement with the open end of the hollow metal tube, and no portion of the bearing surfaces is oriented in a plane which is perpendicular to the longitudinal axis of the tool.

10. The tool as defined in claim 9 wherein there are two cylindrical dowel pins which are regularly disposed around the working surface of the head end of the elongated body.

11. The tool as defined in claim 9 wherein a major portion of the working surface is conical in shape and forms an angle of about thirty degrees with respect to the longitudinal axis of the tool.

12. The tool as defined in claim 9 wherein the acute angle formed by each smooth-surfaced rib with respect to the longitudinal axis of the tool is about thirty degrees.

13. The tool as defined in claim 9 wherein the diameter of the cylindrical surface of the cylindrical tip section is about 0.003 inches smaller than the inner diameter of the metal tube to be flared by the tool.

14. A process for flaring the open end of a hollow metal tube having an inner diameter, the process comprising the steps of:

providing a tool having an elongated body having two opposite end portions and a longitudinal axis extending therebetween, one end portion of said body defining an elongated working surface having two opposite ends and a major portion of the working surface which extends between the two opposite ends is conical in shape so that one end of the working surface is a smaller end and the other end of the working surface is a larger end and wherein the smaller end of the working surface is adapted to be received by an open end of a hollow metal tube when inserted therein and wherein the working surface further includes at least two smooth-surfaced ribs which are regularly spaced around and extend along the entire length of the working surface between the larger and smaller ends thereof to provide the working surface with outwardly-extended smooth-surfaced protuberances, and wherein the one end portion of said body further includes a cylindrical tip section which is joined to and extends axially of the working surface from the smaller end thereof and which has a cylindrical surface which has a diameter which is slightly smaller than the inner diameter of the open end of the hollow metal tube to be flared with the tool for acceptance by the open end of the hollow metal tube when inserted therein and wherein the one end portion further includes cylindrical dowel pins having surfaces and a remainder within which cylindrical dowel pins are rotatably captured and wherein the smooth-surfaced protuberances are provided by the surfaces of the cylindrical dowel pins which are rotatably captured within the remainder of the one end portion to accommodate rotation of the dowel pins about rotation axes and relative to the remainder of the one end portion when the tool is rotated about its longitudinal axis and the surfaces of the cylindrical dowel pins are urged into engagement with the open end of the metal tube and wherein the rotation axis of each dowel pin forms an angle with the longitudinal axis of the tool;

rotating the tool about its longitudinal axis;

inserting the cylindrical tip section into the open end of the hollow metal tube; and urging the smooth-surfaced protuberances into engagement with the open end of the metal tube as the cylindrical surface of the cylindrical tip section maintains the working surface in axial alignment with the metal tube so that the open end of the metal tube is worked upon by the working surface.

15. The process as defined in claim 14 wherein the step of rotating rotates the tool at a speed of between 300 and 400 revolutions per minute (rpm).

16. The process as defined in claim 14 wherein the steps of rotating and inserting are carried out by a computer-controlled machine which is capable of rotating the tool about its longitudinal axis and automatically advancing the tool into engagement with the open end of the metal tube.

* * * * *